US011465816B2

(12) United States Patent
Thompson

(10) Patent No.: US 11,465,816 B2
(45) **Date of Patent: *Oct. 11, 2022**

(54) E-COMMERCE PACKAGE

(71) Applicant: Sonoco Development, Inc., Hartsville, SC (US)

(72) Inventor: Marcy Thompson, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/340,247

(22) Filed: Jun. 7, 2021

(65) Prior Publication Data

US 2021/0292062 A1 Sep. 23, 2021

Related U.S. Application Data

(63) Continuation of application No. 16/694,206, filed on Nov. 25, 2019, now Pat. No. 11,059,640.

(60) Provisional application No. 62/774,522, filed on Dec. 3, 2018.

(51) Int. Cl.
*B65D 55/02* (2006.01)

(52) U.S. Cl.
CPC ..... *B65D 55/026* (2013.01); *B65D 2203/02* (2013.01); *B65D 2203/06* (2013.01); *B65D 2401/15* (2020.05)

(58) Field of Classification Search
CPC ..... B65D 2203/02; B65D 2203/06; B65D 55/026; B65D 2401/15
USPC ..... 206/773, 774, 772, 770, 769, 39.6, 484, 206/736, 807, 459.5; 426/106, 138, 139
See application file for complete search history.

(56) References Cited

U.S. PATENT DOCUMENTS

| | | | | |
|---|---|---|---|---|
| 5,340,158 | A * | 8/1994 | Bartl | G09F 3/0289 283/105 |
| 5,495,944 | A | 3/1996 | Lermer | |
| 5,829,789 | A | 11/1998 | Treleaven et al. | |
| 6,616,189 | B2 * | 9/2003 | Raming | G09F 3/10 283/81 |
| 6,908,113 | B2 * | 6/2005 | Chaduc | G09F 3/0292 206/460 |
| 8,496,110 | B2 | 7/2013 | Raming | |
| 2003/0077363 | A1 | 4/2003 | Cadiente et al. | |
| 2009/0100726 | A1 * | 4/2009 | Regas | B65D 23/085 40/310 |
| 2011/0155625 | A1 * | 6/2011 | Franks | C09J 7/20 40/675 |
| 2012/0006712 | A1 * | 1/2012 | Kaplan | G09F 3/10 220/592.2 |
| 2013/0026055 | A1 * | 1/2013 | Barr | G09F 3/0289 206/459.5 |
| 2013/0043157 | A1 * | 2/2013 | Key | B65D 85/00 206/459.1 |
| 2014/0084579 | A1 | 3/2014 | Asay | |
| 2014/0257843 | A1 * | 9/2014 | Adler | G09F 3/10 283/81 |
| 2016/0130055 | A1 | 5/2016 | Labonski | |

(Continued)

*Primary Examiner* — Rafael A Ortiz

(74) *Attorney, Agent, or Firm* — von Briesen & Roper, s.c.

(57) ABSTRACT

A package for shipping a product ordered via the Internet. The package comprising a container body, an inner label, a closure, an outer label removably attached to and covering all or part of the inner label, and a shipping label adhered to the outer label.

9 Claims, 3 Drawing Sheets

(56) References Cited

U.S. PATENT DOCUMENTS

2016/0167823 A1* 6/2016 Gutekunst ..... B65D 79/0084
215/383

* cited by examiner

E-COMMERCE PACKAGE

CROSS REFERENCE TO RELATED APPLICATION

This application is a continuation of U.S. patent application Ser. No. 16/694,206, filed Nov. 25, 2019. U.S. application Ser. No. 16/694,206 is incorporated here by reference in its entirety to provide continuity of disclosure.

BACKGROUND

Field of the Invention

This patent relates to a package. More particularly, this patent relates to a package for shipping a product ordered via the Internet (a.k.a. "e-Commerce") or telephone and delivered via the post office, private couriers such as UPS and FedEx, local couriers or other delivery services to a buyer's home or other desired location.

Description of the Related Art

The current state of e-Commerce packaging is in flux. Typically, when a product ordered online through e-Commerce, the product, in its original primary packaging, is placed in secondary packaging to protect the product from damage during shipping to the buyer's location. The secondary packaging may consist of an overbox or shipping box with void fill added such as bubble wrap, stuffing, shrink wrap, inflated bags.

This need for secondary packaging results in additional prepping by the consumer products company or the third party fulfillment center. The fulfillment center often passes these charges on to the seller/consumer products company, charging large fees to discourage the need for prepping. In addition, many consumers perceive current e-Commerce deliveries to be over-packaged and environmentally unfriendly. Recently the fulfillment centers have been pushing the consumer products and packaging industries to improve the primary packaging and to achieve what may be referred to as "Prep-Free Packaging" (PFP), "Ship in Own Container" (SIOC) and "Frustration-Free Packaging" (FFP) Solutions.

The present disclosure addresses these concerns.

SUMMARY OF THE INVENTION

The present disclosure relates to an e-Commerce package for shipping goods from a shipper to a recipient.

In one aspect the package comprises a primary package comprising a container body, an inner label and a closure, an outer label and a shipping label. The container body comprises an inner liner and a paperboard structural layer. The container body is suitable for holding food. The container body has an opening for allowing access to the food. The inner label is adhered to and covers an exterior surface of the paperboard structural layer. The closure is adapted for closing the opening.

The outer label is removably attached to the inner label and may cover all or part of the inner label. The shipping label is adhered to the outer label, and may bear information regarding the shipper and the recipient. An optional tamper evident plastic security seal may be applied over at least part of the closure and at least part of the outer label.

In another aspect, the package comprises a primary package, an outer label and a shipping label. The primary package comprises a container body for holding one or more products, an inner label and a closure. The container body may be cylindrical or any suitable shape and has an opening for allowing access to the one or more products. The inner label may be adhered to the container body and may bear graphics like a typical branded label. The closure is configured to close the opening.

The outer label may be removably attached to the primary package. The outer label covers all or part of the inner label. The shipping label may be adhered to the outer label. The shipping label may bear information as to shipper identity and recipient address.

THE DRAWINGS

DETAILED DESCRIPTION OF THE INVENTION

Figure 1:
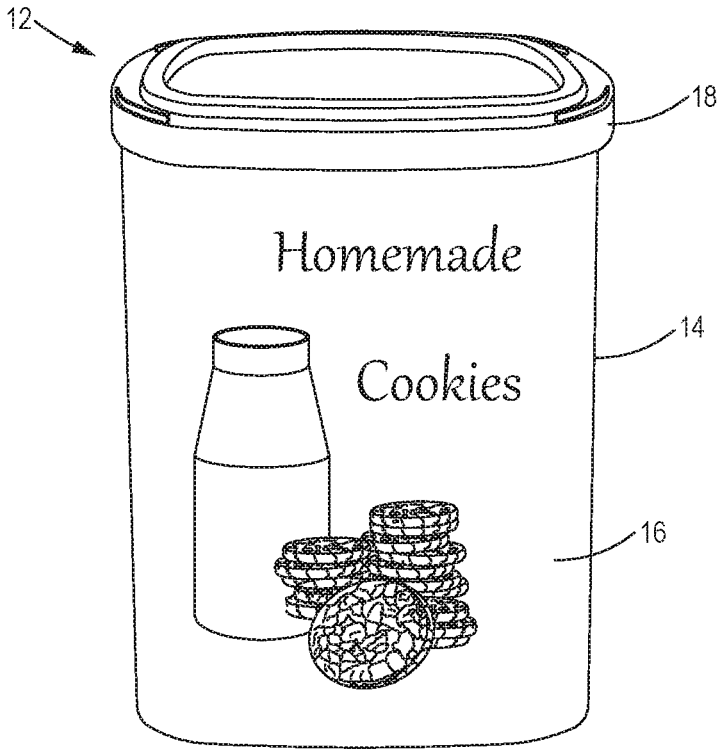
FIG. 1 is a perspective view of a conventional primary package.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, FIG. 1 is a perspective view of a conventional primary package 12. The primary package 12 may comprise a container body 14 having an opening 15 for allowing access to the contents, a label 16 and a closure 18 for closing the opening 15. The primary package 12 may be any type of package suitable for holding a product and for e-Commerce shipping. For example and without limitation, the container body 14 may be a cylindrical composite container suitable for holding drink mixes, snacks and other foods. A typical composite container suitable for holding food comprises an inner liner and a paperboard structural layer having an exterior surface covered by an outer label 16.

The primary package 12 may also comprise a plastic, metal or paper bottom (not shown in the figures) and a plastic, metal or paperboard closure 18 such as a lid or overcap. A seal membrane (not shown the figures) may be positioned under the closure 18 and sealed to the top edge of the container body 14 to help maintain the freshness of the contents and extend its shelf life. Alternatively, the closure 18 may be sealed directly to the container body 14.

Figure 2:
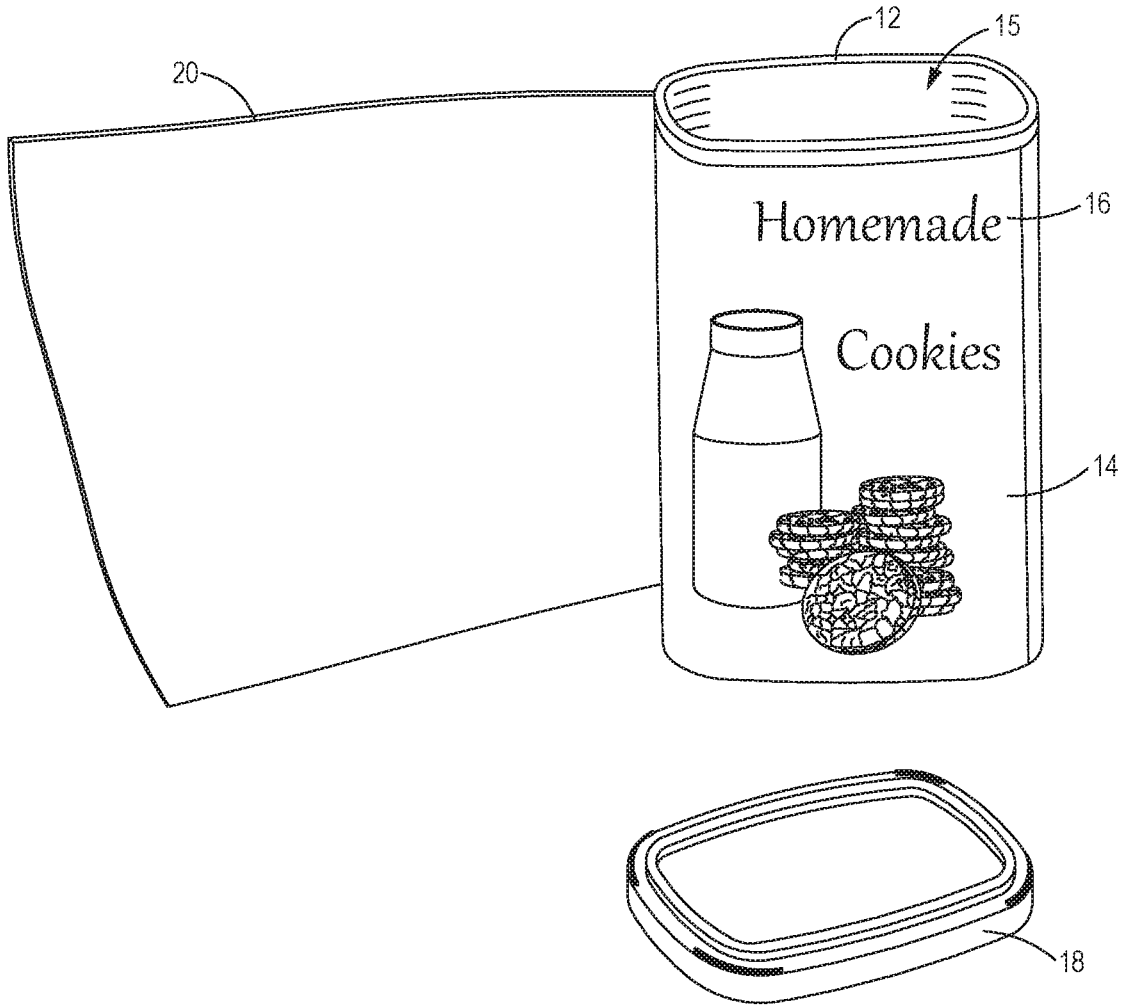
FIG. 2 is a perspective view of a partially assembled e-Commerce package according to the disclosure.

FIG. 2 is a perspective view of a partially assembled e-Commerce package according to the disclosure.

As an initial step in the manufacture of the e-Commerce package 10, the goods are packaged in their primary packaging 12 by, for example, a third party such as a co-packer or CPG. As noted above, the primary package 12 includes the container body 14, the label 16 and the closure 18.

An outer label 20 is applied over the (inner) label 16 and is removably adhered to the primary package 12 and/or the inner label 16. Preferably the outer label 20 overlays or covers (and thus obscures) the entire inner label 16 and is adhered to itself by pressure sensitive adhesive (PSA) or other adhesive so that the outer label 20 can be easily removed.

The outer label 20 may include a small corner bearing a "Peel Here" or other indicator that is not adhered to the outer label 20 and so can be easily lifted away from the underlying outer label 20. The outer label 20 may be wound onto the container body 14 over the inner label 16, either by spiral or convolute winding.

The outer label 20 may be plain or it may bear graphics. If it bears graphics, a blank space may be left on the outer label 20 for the placement of shipping information. The placement of shipping information may be done by printing directly on the outer label 20 or by adhering a separate shipping label 22 to the outer label 20.

Optionally, the outer label 20 and the branded label 16 may he applied as a two ply label, a.ka. "double label", during the manufacture of the primary package 12, in which case the two play label, consisting of both the branded label 16 and the outer label 20, may be wound onto the container body 14 over the container body 14 either by spiral or convolute winding.

Figure 3:
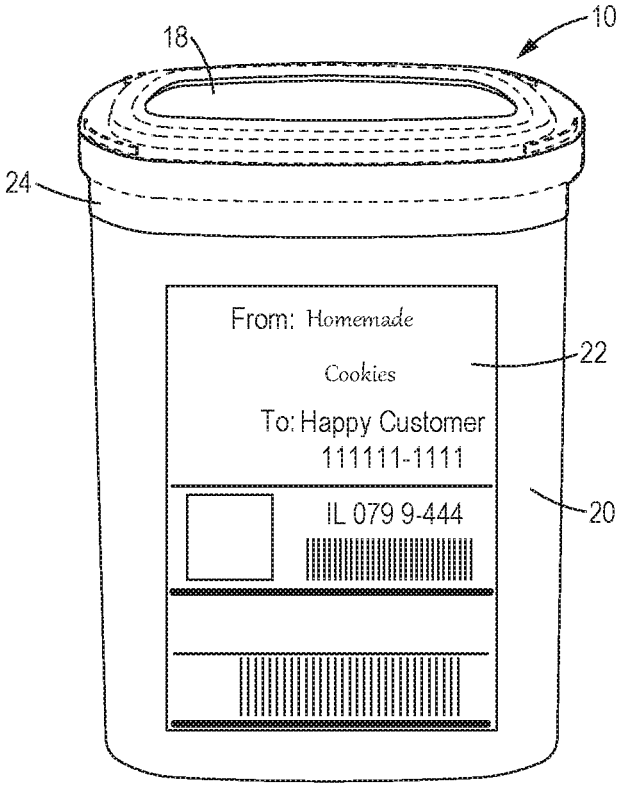
FIG. 3 is a perspective view of the e-Commerce package of FIG. 2 after assembly and with a plastic seal added.

The combination of a primary package 12 and the removable outer label 20 is intended to eliminate the need for a secondary package, as well as void fill, in which shippers often ship the primary package 12. FIG. 3 is a perspective view of the e-Commerce package 10 of FIG. 2 after assembly and with a plastic seal 24 added. The e-Commerce package 10 comprises the primary package 12, the outer label 20 and a shipping label 22.

The outer label 20 may obscure (cover) all of part of the inner label 16.

The shipping label 22 may be adhered to the outer label 20. The shipping label 22 may bear information such as the shipper identity, the name and address of the recipient, and also machine readable codes such as a UPC bar code.

A tamper evident feature such as a plastic seal 24 may be applied over the package closure 18 and part of the outer label 20. Alternatively, a tamper evident feature may be embedded in or otherwise incorporated into the closure 18. In any case, preferably the tamper evident feature must be removed prior to removing the outer label 20. The tamper evident feature may be configured so that it will be visibly damaged or changed if the outer label 20 is removed.

Once the consumer receives the package 10 through e-Commerce, they can remove the plastic seal 24 (if present) and then peel off the outer label 20, revealing the permanent inner "branded" label 16. The customer can recycle the outer label 20 (assuming its materials of construction, e.g., ink, adhesive etc., are compatible with the recycle stream).

The package described herein can greatly simplify the current supply chain and achieve the goal of having products Shipped in (Their) Own Container(s) (SIOC) without the need to prep (PFP), and can eliminate seller chargeback fees. The package can also improve the consumer experience, providing a more environmentally friendly e-Commerce solution that greatly reduces the packaging to product ratio.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. An e-commerce package for shipping a product ordered via the Internet and delivered via a delivery service from a shipper to a recipient without the need for secondary packaging, the package comprising:

a primary package comprising a cylindrical container body, an inner label and a closure;

the container body comprising an inner liner and a paperboard structural layer, the container body being suitable for holding content, the container body having an opening for allowing access to the content;

the inner label adhered to and covering an exterior surface of the paperboard structural layer;

the closure adapted for closing the opening;

the package further comprising:

a plain outer label removably attached to the primary package, the outer label covering the inner label such that the outer label obscures the entire inner label, the outer label wound onto the container body and adhered to itself by pressure sensitive adhesive, the outer label including a small corner that is not adhered to the rest of the outer label so that the corner can easily be lifted away from the underlying outer label;

a shipping label adhered to the outer label, the shipping label bearing information regarding the shipper and the recipient; and a tamper evident plastic security seal applied over at least part of the closure and at least part of the outer label.

2. The package of claim 1 wherein:

the shipping label bears a machine readable code.

3. The package of claim 1 wherein:

the shipping label bears information as to shipper identity and recipient address.

4. The package of claim 1 wherein:

the tamper evident plastic security seal is configured so that it must be removed prior to removing the outer label.

5. A method of manufacturing the e-commerce package of claim 1, the method comprising the steps of:

by a co-packer, packaging the product in the primary packaging;

by a second party, removably attaching the plain outer label to the primary package by winding the plain outer label onto the container body and adhering the outer label to itself with pressure sensitive adhesive so that the outer label obscures the entire inner label;

adhering the shipping label to the outer label; and applying a tamper evident plastic security seal over at least part of the closure and at least part of the outer label.

6. An e-commerce package for shipping a product ordered via the Internet and delivered via a delivery service from a shipper to a recipient without the need for secondary packaging, the package comprising:

a primary package comprising a container body, an inner label and a closure;

the container body suitable for holding content and having an opening for allowing access to the content;

the inner label adhered to and covering an exterior surface of the container body;

the closure adapted for closing the opening;

the package further comprising:

a plain outer label removably attached to the primary package, the outer label covering the inner label such that the outer label obscures the entire inner label, the outer label wound onto the container body and adhered to itself by pressure sensitive adhesive, the outer label including a small corner that is not adhered to the rest of the outer label so that the corner can easily be lifted away from the underlying outer label;

a shipping label adhered to the outer label, the shipping label bearing information regarding the shipper and the recipient; and a tamper evident plastic security seal applied over at least part of the closure and at least part of the outer label.

7. The package of claim 6 wherein:

the shipping label bears a machine readable code.

8. The package of claim 6 wherein:

the shipping label bears information as to shipper identity and recipient address.

9. The package of claim 6 wherein:

the tamper evident plastic security seal is configured so that it must be removed prior to removing the outer label.

* * * * *